US006819214B2

(12) United States Patent
Elliott et al.

(10) Patent No.: US 6,819,214 B2
(45) Date of Patent: Nov. 16, 2004

(54) COMPONENT CORE WITH COIL TERMINATIONS

(75) Inventors: Brent Elliott, Boca Raton, FL (US); Robert Bogert, Lake Worth, FL (US)

(73) Assignee: Cooper Technologies Company, Houston, TX (US)

( * ) Notice: Subject to any disclaimer, the term of this patent is extended or adjusted under 35 U.S.C. 154(b) by 107 days.

(21) Appl. No.: 10/255,886

(22) Filed: Sep. 26, 2002

(65) Prior Publication Data

US 2003/0071707 A1 Apr. 17, 2003

Related U.S. Application Data

(60) Provisional application No. 60/325,603, filed on Sep. 28, 2001.

(51) Int. Cl.[7] ..... H01F 27/28
(52) U.S. Cl. ..... 336/229; 336/192
(58) Field of Search ..... 336/229, 200, 336/83, 192, 223

(56) References Cited

U.S. PATENT DOCUMENTS 3,585,553 A * 6/1971 Muckelroy et al. ..... 336/192
3,613,033 A * 10/1971 Denes ..... 333/182
3,691,497 A * 9/1972 Bailey et al. ..... 336/192
4,777,461 A * 10/1988 Sakamoto ..... 333/184
5,165,162 A 11/1992 Charles
5,877,666 A * 3/1999 Johnson et al. ..... 336/180
6,246,311 B1 * 6/2001 Finnemore et al. ..... 336/192
6,292,081 B1 9/2001 Armfield et al.
6,492,893 B2 * 12/2002 De Graaf ..... 336/229
6,570,478 B2 * 5/2003 Meeks ..... 336/229
6,621,397 B2 * 9/2003 Hsu ..... 336/96
6,680,664 B2 * 1/2004 Fan ..... 336/83
2003/0141952 A1 * 7/2003 Moro et al. ..... 336/90

FOREIGN PATENT DOCUMENTS

JP 01183906 A * 7/1989 ..... H03H/7/01
JP 07106143 A * 4/1995 ..... H01F/17/06

OTHER PUBLICATIONS

International Search Report, dated Jun. 2, 2003, Application No. PCT/US02/30080.

* cited by examiner

*Primary Examiner*—Anh Mai
(74) *Attorney, Agent, or Firm*—Armstrong Teasdale LLP

(57) ABSTRACT

A core assembly for a surface mount electronic component is provided. The core assembly comprises a core fabricated from a magnetic permeable material, and at least one conductive coil termination embedded within said core.

21 Claims, 1 Drawing Sheet

COMPONENT CORE WITH COIL TERMINATIONS

CROSS REFERENCE TO RELATED APPLICATIONS

This application claims the benefit of U.S. Provisional Patent Application Ser. No. 60/325,603 filed Sep. 28, 2001.

BACKGROUND OF THE INVENTION

This invention relates generally to manufacturing of surface mount electronic components including magnetic cores, and more specifically to manufacturing of surface mount inductors.

Manufacturing processes for electrical components have been scrutinized as a way to reduce costs in the highly competitive electronics manufacturing business. Reduction of manufacturing costs are particularly desirable when the components being manufactured are low cost, high volume components. In a high volume component, any reduction in manufacturing costs is, of course, significant. Manufacturing costs as used herein refers to material cost and labor costs, and reduction in manufacturing costs is beneficial to consumers and manufacturers alike.

A variety of electrical components such as transformers and inductors include at least one winding disposed about a magnetic core. For example, at least one type of inductor includes a conductive wire coil wrapped around a toroid-shaped ferromagnetic core, and each end of the coil includes a lead for coupling the inductor to an electronic circuit. As the size of the component is reduced, and especially for surface mount components, the coil leads can be fragile and difficult to connect to a circuit. Therefore, in one type of inductor, for example, a header assembly is adhesively bonded to the core and the coil leads are wrapped about terminals of the header assembly to facilitate connection of the coils to external circuitry. Aside from the time and cost involved of applying and curing the adhesive, the adhesive bond generates stress in the core, which reduces magnetic permeability of the core and degrades desirable properties of the core in use. While reduced magnetic permeability of the core may be mitigated by adding additional turns of the coil to compensate for the affected properties of the core, this is not an efficient solution from a manufacturing standpoint.

Still further, when automated equipment is used to install the component, such as in surface mount applications, additional external components are typically employed to protect the coil leads and termination assemblies during handling by automated equipment. These components further add to manufacturing costs.

BRIEF DESCRIPTION OF THE INVENTION

In one aspect, a core assembly for a surface mount electronic component is provided. The core assembly comprises a core fabricated from a magnetic permeable material, and at least one conductive coil termination embedded within said core.

In another aspect, a surface mount electrical component is provided. The electrical component comprises a ferromagnetic core comprising at least one integral conductive coil termination, and a coil wound around said core. The coil comprises at least one lead and the lead is coupled to said at least one conductive termination.

In another aspect, a surface mount electrical component is provided. The component comprises a ferromagnetic core comprising an opening therein and at least one integral conductive coil termination pre-formed into said core, a coil wound around said core, and a pliable plug extending from said core and comprising a flat upper surface forming an engagement surface for surface mount technology equipment. The coil comprises at least one lead coupled to said at least one conductive coil termination.

In another aspect, a method for assembling a surface mount electrical component including a core and coil wound about the core is provided. The method comprises providing a core including at least one integral coil termination pre-formed therein, winding the coil about the core, and attaching the at least one lead to the at least one coil termination.

In still another aspect, a method of mounting a surface mount electrical component including a core and a coil wound about the core is provided. The method comprises providing a core including first and second coil terminations pre-formed therein, winding the coil about the core, the coil including first and second leads, attaching the first coil lead to the first coil termination, attaching the second coil lead to the second coil termination, and coupling a pliable plug to the core. The plug comprises a flat outer surface, and using the flat outer surface of the plug, the conductive coil terminations are positioned in contact with conductive portions of a printed circuit board to surface mount the electrical component to the board, thereby establishing an electrical connection through the coil.

In an exemplary embodiment of the invention, a toroid core and coil assembly includes coil terminations integrally formed into the core for facilitating quick and relatively simple connection of the coil leads without external components and associated adhesive bonding processes. The terminations include contoured surfaces to guide coil leads and facilitate connection of the leads to the terminations. Stress on the core which degrades desired magnetic properties is therefore substantially avoided, together with associated additional coil turns to compensate for degraded properties, thereby further reducing manufacturing costs. In addition, the core and coil assembly is easily accommodated by automated equipment by insertion of a pliable plug including a flat surface that facilitates vacuum pick up with surface mount technology assembly equipment.

DETAILED DESCRIPTION OF THE INVENTION

Figure 1:
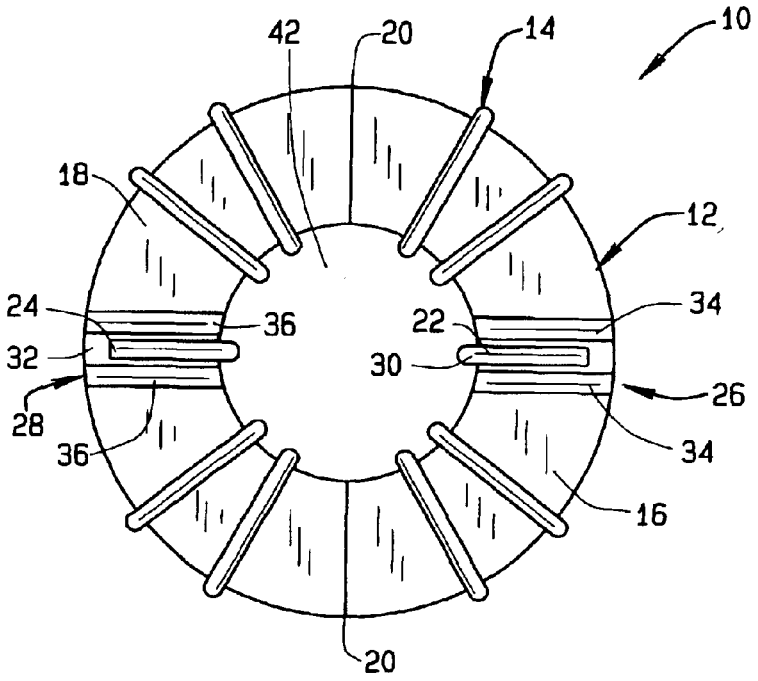
FIG. 1 is a top plan view of a portion of a toroid core and coil assembly according to the present invention.

FIG. 1 is a top plan view of a portion of a toroid core and coil assembly 10 according to the present invention. In one embodiment, the advantages of core and coil assembly have found particular use in the manufacture of inductor components that are widely used in a variety of electronic circuits. It is appreciated, however, that the instant advantages of the present invention are equally applicable to other types of components wherein such core and coil assemblies are employed, such as, for example, transformer components. Thus, as the benefits of the invention accrue generally to electric components including toroid core and coil assemblies, the description set forth herein is intended for illustrative purposes only and without intention to limit practice of the invention to any particular type of electric component or to any particular end-use application.

Assembly 10 includes a core 12 and a coil 14. Core 12 is fabricated from a known magnetic permeable material, such as ferrite in one embodiment, and includes two substantially similar halves 16, 18 separated by a small gap 20 according to techniques known in the art. Each core half 16, 18 is formed into a toroidal shape familiar to those in the art. In various embodiments, core 12 is fabricated from conductive and nonconductive ferromagnetic materials to meet specified performance objectives. In further embodiments, core 12 may be of other shapes familiar to those in the art, including but not limited to E-shaped cores and rectangular cores while achieving the advantages of the instant invention.

Coil 14, in one embodiment, is fabricated from a known conductive material and includes a number of turns extending over the surface of coil halves 16, 18 to achieve a desire effect, such as, for example, a desired inductance value for a selected end use application of coil and core assembly 10. In an illustrative embodiment, coil 14 is formed from a conductive wire according to known techniques and includes a first lead 22 and a second lead 24 at opposite ends of coil 14. As those in the art will appreciate, an inductance value of inductor core and coil assembly 10, in part, depends upon wire type, a number of turns of wire in the coil, and wire diameter. As such, inductance ratings of inductor 10 may be varied considerably for different applications.

In accordance with known methods and techniques, wire used to form coil 14 may be coated with enamel coatings and the like to improve structural and functional aspects of coil 14.

Unlike conventional cores, core 12 includes integral conductive terminations 26, 28 in each respective core half 16, 18 to facilitate connections of respective coil leads 22, 24. In an illustrative embodiment, terminations 26, 28 are fabricated from known conductive materials and are embedded within core 12 during manufacture of core halves 16, 18 to provide a pre-formed core 12 including coil terminations 26, 28. In different embodiments, terminations 26, 28 may be applied to core 12 in various stages of the manufacturing process. For example, terminations 26, 28 could be incorporated in a relatively early stage of core production, or terminations 26, 28 could be applied with, for example, known printing, silk-screening, and plating techniques at a relatively later stage after ferrite core 12 has been finished.

Terminations 26, 28 simplify connection of coil 14 to core 12 by eliminating the use of conventional external coil termination components and associated time intensive adhesive bonding procedures in known core and coil assemblies. In addition, conventional additional turns of coil 14 to compensate for reduced magnetic permeability of core 12 attributable to adhesive bonding of coil termination components to the core are avoided. As such, material costs and assembly costs of core and coil assembly 10 are reduced in comparison to known toroid core and coil assemblies, thereby reducing overall manufacturing costs. These costs, of course, can be especially significant when core and coil assembly 10 is employed in high volume, surface mount applications.

In an illustrative embodiment, each termination 26, 28 includes a depressed surface 30, 32, respectively, that is approximately centered between ridges 34, 36, respectively. Therefore, coil leads 22, 24 may be guided by ridges 36, 34 into depressed surfaces 24 for attachment of leads 22, 24 to coil terminations 22, 24. It is contemplated, however, that terminations 26, 28 may be alternatively shaped in other embodiments without departing from the scope of the present invention Additionally, while terminations 26, 28 are illustrated in an approximately centered position with respect to each core half 16, 18, terminations could be located elsewhere in core halves 16, 18 as desired without departing from the scope of the present invention.

In a further embodiment, insulating material (not shown in FIG. 1) may be employed to insulate terminations 26, 28 from core halves 16, 18, as desired.

It is contemplated that additional components, such as protective shields, may be employed with core and coil assembly 10 as desired or as necessary for particular end use applications. Such shields and components, for example, may be employed to contain an electromagnetic field of the core and coil assembly in use, and to reduce the effect of the field on the ambient environment. As details of these components are believed to be within the purview of those in the art and generally beyond the scope of the present invention, further discussion of these components is omitted.

While the illustrated embodiment includes one winding 14 and two coil terminations 26, 28 integrally formed into core 12, in alternative embodiments, it is contemplated that more than one winding and more than two terminations could be employed while achieving the benefits of the instant invention. For example, a primary winding and a secondary winding could be employed with respective pairs of coil terminations 26, 28 to facilitate connection of leads of the primary winding and the secondary winding. With appropriate selection of the number of turns of the primary and secondary windings in such an embodiment, a step-up or step-down transformer is provided with reduced manufacturing costs by virtue of the coil terminations pre-formed into the core halves. It is understood that further components neither described nor depicted herein may be employed as needed or as desired to provide an acceptable transformer for particular applications. As details of these components are also believed to be within the purview of those in the art and generally beyond the scope of the present invention, further discussion of these components is omitted.

Figure 2:
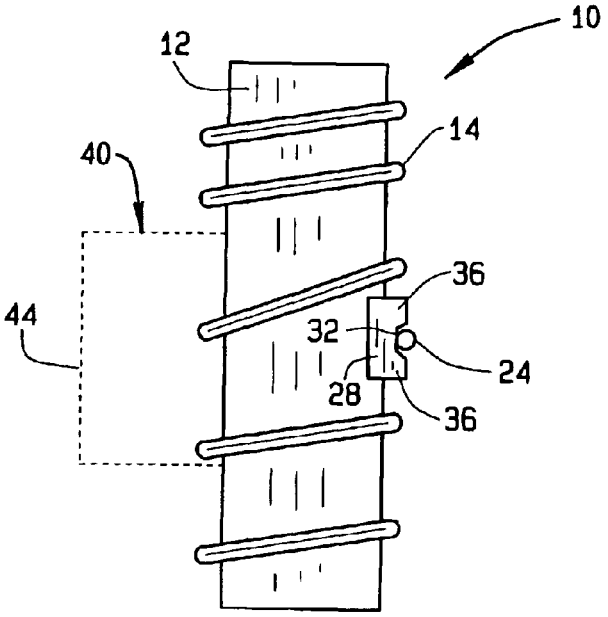
FIG. 2 is a side elevational view of the toroid coil and core assembly shown in FIG. 1.

FIG. 2 is a side elevational view of the toroid core and coil assembly 10 illustrating coil 14 wrapped around core 12 and coil lead 24 coupled to coil termination 28. Lead 28 is positioned in termination depressed surface 32 between ridges 36 and is coupled to terminations 28 with known techniques, including but not limited to soldering methods and processes. Because terminations 26 (shown in FIG. 1) and 28 are pre-formed into core 12, costly manufacturing steps of adhesively bonding an external termination component to core 12 is eliminated. Rather, coil leads may be simply and relatively easily attached to terminations 26 and 28. Assembly 10 may then be surface mounted to a printed circuit board (not shown) with terminations 26 and 28 forming an electrical path for connection of coil 14 to an electrical circuit in the board. Alternatively, other connecting leads (not shown) may be coupled to terminations 26, 28 to complete an electrical connection between terminations 26, 28 and coil leads 22, 24 and the connecting leads to complete an electrical circuit through assembly 10.

Additionally, external stresses on core 12 associated with adhesive bonds and external termination components are avoided, thereby preserving magnetic properties of the core and allowing comparable performance of conventional core and coil assemblies with a reduced number of coil turns.

It is contemplated that additional terminations similar to terminations 26, 28 may be employed on each side of core 12 (i.e., on the left and right sides of core 12 in FIG. 2) to form a symmetrical core 12 about a plane extending radially through the center of core 12. As such, placement of terminations on both sides of core 12 avoids particular manipulation of core halves (e.g. precise positioning of conductor side up or conductor side down) due to the presence of a termination on only one side.

In another aspect, terminations 26, 28 formed integrally with core 12 facilitate surface mounting of assembly 10 without protective components installed over terminations to protect coil leads 22, 24 during handling by known surface mount technology (SMT) assembly equipment (not shown). Conventionally, relatively small inductors and transformers are difficult to coordinate with vacuum pick ups of SMT equipment. However, by inserting a cylindrical plug 40 (shown in phantom in FIG. 2) into an inner opening 42 (shown in FIG. 1) of toroid shaped core 12, a flat surface 44 is provided that is easily accommodated by vacuum pick ups of an SMT placement machine. In one embodiment, plug 30 is fabricated from known resilient, flexible, pliable materials that may be inserted and removed from opening 42 without damaging core 12 or coil 14. In another embodiment, plug 30 is applied to opening 42 in a liquid or viscous form and then appropriately cured or solidified to form plug 40 with flat surface 44. It is recognized that in such an embodiment, plug 40 is not intended for removal from opening 44 and that plug flat surface 44 would extend substantially flush with the surface of the wound coil, which has an added benefit or reducing component size.

Thus, by virtue of plug flat surface 44, a large number of assemblies 10 may be rapidly and accurately installed on a printed circuit board without compromising assembly 10.

It is appreciated that flat surface 44 may extend within inner opening 42 on either side of assembly 10 and may be extended outwardly or inwardly from assembly 10, including a generally flush arrangement, as mounting needs dictate.

For all the above reasons, core and coil assembly 10 provides an adequate toroid core and coil with a simplified construction and reduced manufacturing costs.

While the invention has been described in terms of various specific embodiments, those skilled in the art will recognize that the invention can be practiced with modification within the spirit and scope of the claims.

What is claimed is:

1. A core assembly for a surface mount electronic component, said core assembly comprising:

a core fabricated from a magnetic permeable material; and at least one conductive coil termination embedded within said core, said termination configured to receive a wire lead.

2. A core assembly in accordance with claim 1 wherein said surface mount electronic component is an inductor.

3. A core assembly in accordance with claim 2 wherein said inductor is a toroid inductor.

4. A core assembly in accordance with claim 3 wherein said core comprises a first core half, a second core half and a gap therebetween, said at least one conductive termination located in one of said first core half and said second core half.

5. A core assembly in accordance with claim 1 wherein said at least one termination comprises a first ridge, a second ridge, and a depressed surface between said first ridge and said second ridge, said wire lead being received in said depressed surface.

6. A core assembly in accordance with claim 1 wherein said core comprises an opening therethrough, said core assembly further comprising a plug extending at least partly through said opening, said plug comprising a flat surface for accommodation by surface mount technology equipment.

7. A core assembly in accordance with claim 6 wherein said core is a toroid core comprising an inner opening therethrough, said plug comprising a cylindrical plug extending through said inner opening.

8. A core assembly in accordance with claim 7 wherein said plug is fabricated from a pliable material.

9. A surface mount electrical component comprising:

a ferromagnetic core comprising at least one integral conductive coil termination; and a coil wound around said core, said coil comprising at least one wire lead, said wire lead coupled to said at least one conductive termination.

10. A surface mount electrical component in accordance with claim 9 wherein said at least one conductive coil termination comprises a first ridge, a second ridge, and a depressed surface between said first ridge and said second ridge, said coil lead coupled to said depressed surface.

11. A surface mount electrical component in accordance with claim 9 wherein said component is an inductor, said core comprising a first core half, a second core half and a gap therebetween, said at least one termination preformed into one of said first core half and said second core half.

12. A surface mount electrical component in accordance with claim 11 wherein said core comprises a toroid core.

13. A surface mount electrical component in accordance with claim 9 further comprising a pliable plug coupled to said core.

14. A surface mount electrical component in accordance with claim 13 wherein said core comprises an opening therein, said plug extending through said opening.

15. A surface mount electrical component in accordance with claim 14 wherein said plug comprises a flat upper surface, thereby providing an engagement surface for surface mount technology equipment.

16. A surface mount electrical component comprising:

a ferromagnetic core comprising an opening therein and at least one integral conductive coil termination pre-formed into said core;

a coil wound around said core, said coil comprising at least one wire lead, said lead at least one wire lead coupled to said at least one conductive coil termination; and a pliable plug extending from said core and comprising a flat upper surface forming an engagement surface for surface mount technology equipment.

17. A surface mount electrical component in accordance with claim 16 wherein said core is a toroid core.

18. A surface mount electrical component in accordance with claim 17 wherein said toroidal core comprises a first core half, a second core half and a gap in between said first core half and said second core half.

19. A method for assembling a surface mount electrical component including a core and a wire coil wound about the core, the wire coil comprising at least one wire lead, said method comprising:

providing a core including at least one integral coil termination pre-formed therein;

winding the wire coil about the core; and attaching the at least one wire lead to the at least one coil termination.

20. A method in accordance with claim 19 wherein said providing a core comprises providing a toroid core including a first core half and a second core half, each of the core first half and second half comprising a coil termination.

21. A method of mounting a surface mount electrical component including a core and a wire coil wound about the core, the coil having first and second wire leads, said method comprising:

providing a core including first and second coil terminations pre-formed therein;

winding the wire coil about the core;

attaching the first wire lead to the first coil termination;

attaching the second wire lead to the second coil termination;

coupling a pliable plug to the core, the plug comprising a flat outer surface; and using the flat outer surface of the plug, positioning the conductive coil terminations for surface mounting to conductive portions of a printed circuit board, thereby establishing an electrical connection through the coil.

* * * * *